United States Patent [19]

Chang

[11] Patent Number: 4,750,539

[45] Date of Patent: Jun. 14, 1988

[54] VERTICAL BLINDS

[76] Inventor: A-Shen Chang, No. 15, Lane 494, Fu Chien Road, Fu Hsing Ts'un, Fu Hsing Hsiang, Changhua Hsien, Taiwan

[21] Appl. No.: 927,715

[22] Filed: Nov. 7, 1986

[51] Int. Cl.[4] ..... E06B 9/36

[52] U.S. Cl. ..... 160/176.1; 160/178.1

[58] Field of Search ..... 160/176 R, 168 R, 168 A, 160/166 A, 166 R, 178 R, 178 B, 263, 39

[56] References Cited

U.S. PATENT DOCUMENTS

| | | | |
|---|---|---|---|
| 2,110,005 | 3/1938 | Rees | 248/188.2 |
| 2,673,608 | 3/1954 | Nelson | 160/178 R |
| 3,343,588 | 9/1967 | Cayton | 160/176 R |
| 3,789,905 | 2/1974 | Saito | 160/168 R |
| 3,996,988 | 12/1976 | deWit | 160/168 R |
| 4,425,955 | 1/1984 | Kaucic | 160/168 R |
| 4,449,564 | 5/1984 | Hansen et al. | 160/168 R X |
| 4,557,159 | 12/1985 | Gross | 160/176 R X |
| 4,567,930 | 2/1986 | Fischer | 160/166 R |

FOREIGN PATENT DOCUMENTS

| | | | |
|---|---|---|---|
| 457042 | 5/1949 | Canada | 160/178 R |

*Primary Examiner*—Ramon S. Britts
*Assistant Examiner*—David M. Purol
*Attorney, Agent, or Firm*—Browdy and Neimark

[57] ABSTRACT

Vertical venetian blind skyrail permitting lateral adjustments, provision of a number of spacers hanging at the lengthened foot bumpers over both side lids of the skyrail at their intersections with the skyrail sheath, so that the transverse length of the skyrail is extended. With coordinated receding of the locking position applied by rotary sleevings which are structured like rotary, helical mandrels, it is made possible adjust lengthwise the lateral length of the skyrail, so as to better accommodate inadequacy of the railing size thereby.

2 Claims, 2 Drawing Sheets

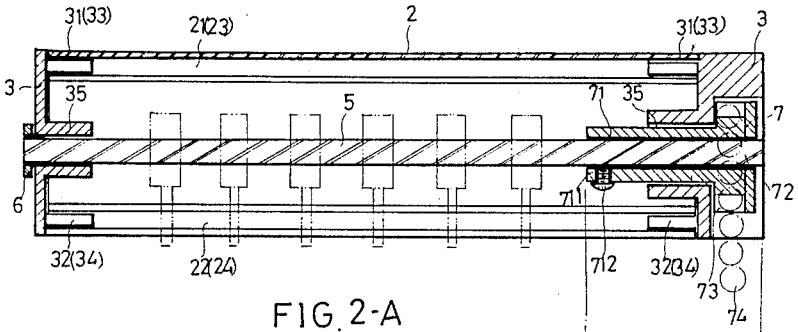
FIG. 2-A
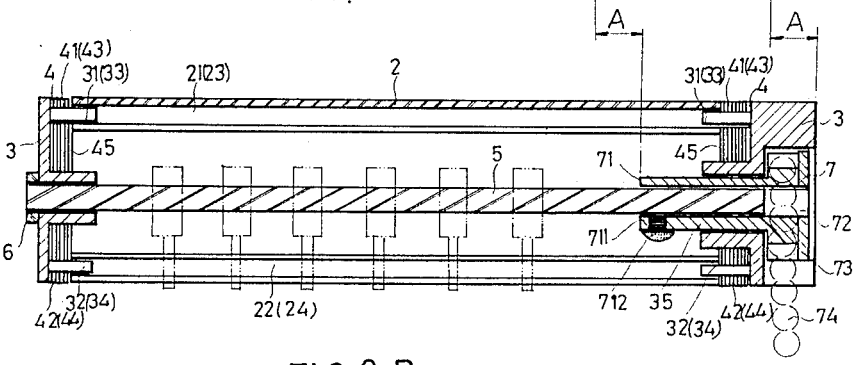
FIG. 2-B

VERTICAL BLINDS

BACKGROUND OF THE INVENTION

This invention relates to apparatus for mounting a vertical blind, and more particularly to apparatus in which lateral adjustment of the blind is achieved through a rotatable mandrel.

A conventional vertical Venetian Blind, owing to the fact that the skyrail, with regard to its lateral dimension, is restricted by fixed specification, often faces the difficulty of the lateral length failing to match the installation position, the lateral width of the window in particular, either because the lateral length is too long or else too short, the worst case being when it is entirely impossible to perform the installation at all. The basic reasons for such a difficulty lies primarily in the fixed setting of the skyrail, which is not flexible, and thus is not compromising for any adjustments or adaptions, so that it is eventually unavoidable to result in dimensional aberrations of the width of window structured according to indoor partitioning practices.

SUMMARY OF THE INVENTION

In view of such difficulties encountered in the installation of vertical Venetian Blinds, the inventor proceeded to work for improvements to overcome them, and finally succeeded in the presentation of the invention titled Vertical Venetian Blind Skyrail permitting lateral adjustments.

The invention provides apparatus for mounting a vertical blind, comprising an elongated frame of inverted, channel-shaped cross-section, a mandrel, means mounting the mandrel for rotation relative to the frame, and means for imparting rotation to the mandrel, the mounting means comprising end covers which are fittable onto the ends of the frame, in which spacers are provided that are interposable between the end covers and the frame whereby to enable the overall length of the apparatus to be adjusted.

The means for imparting rotation to the mandrel is preferably releasably connected to the mandrel to allow its position along the mandrel to be adjusted and it is preferably connectable to the mandrel to allow its position along the mandrel to be adjusted and it is preferably connectable to the mandrel via access from below the frame when the apparatus is in position.

More specifically, the present invention concerns the provision of a plurality of spacers hanging over the lengthened foot bumpers over the periphery of both of the lateral lids and the skyrail covering sheath of a vertical Venetian Blind Skyrail, known as Vertical Venetian Skyrail permitting lateral adjustments hereunder. It is characterized in that the width clearance produced out of the superposition of the spacers serves to lengthen the lateral length of the skyrail, what with the coordinated receding of the rotary sleevings, by locking of position discharged by the swivel sleeving for the rotary, helical mandrel, so that the device can better adapt to inadequate sizing of the skyrail for installation, to enlarge scope of operation.

An advantage of such development is that it can provide a vertical venetian blind skyrail permitting lateral adjustments, whereby an additionally provided spacers are hung between the side lid and the skyrail so as to prolong the length of the skyrail. Such spacers may be superposed to achieve adjustment of thickness and dimension, thereby providing a more flexible specification of the lateral dimension of the skyrail. This simplifies the installation procedure, without having to take precise dimensions before execution, in short making the operation more flexible than ever.

A further advantage is that the present invention can provide a vertical venetian blind skyrail permitting lateral adjustments, whereof the side lids of both sides of the skyrail are complete with foot bumper devices provided by extension, to serve to increase the hanging amplitude of the spacers, thereby providing increased latitude of the transverse dimension thereof.

Still another advantage to provide a vertical venetian blind skyrail permitting lateral adjustments, whereof extension is made of the frontal sleeving of the rotary sleeving. Locking teeth can be provided on the lateral side of the sleeving, which, together with additionally provided spacers hanging over the foot bumper as extended from the interior of the side lid, serve to adjust the horizontal length of the skyrail.

There now follows a description of an embodiment of the invention given by way of illustration, but not in any way limiting, with reference to the accompanying drawings in which:

BRIEF DESCRIPTION OF THE DRAWINGS

FIG. 2A is a sectional view through the blind of FIG. 1 whereof lengthwise extension has not been made, and FIG. 2B is a sectional view through the blind of FIG. 1 whereof lengthwise extension has been accomplished.

DESCRIPTION OF PREFERRED EMBODIMENTS

Figure 1:
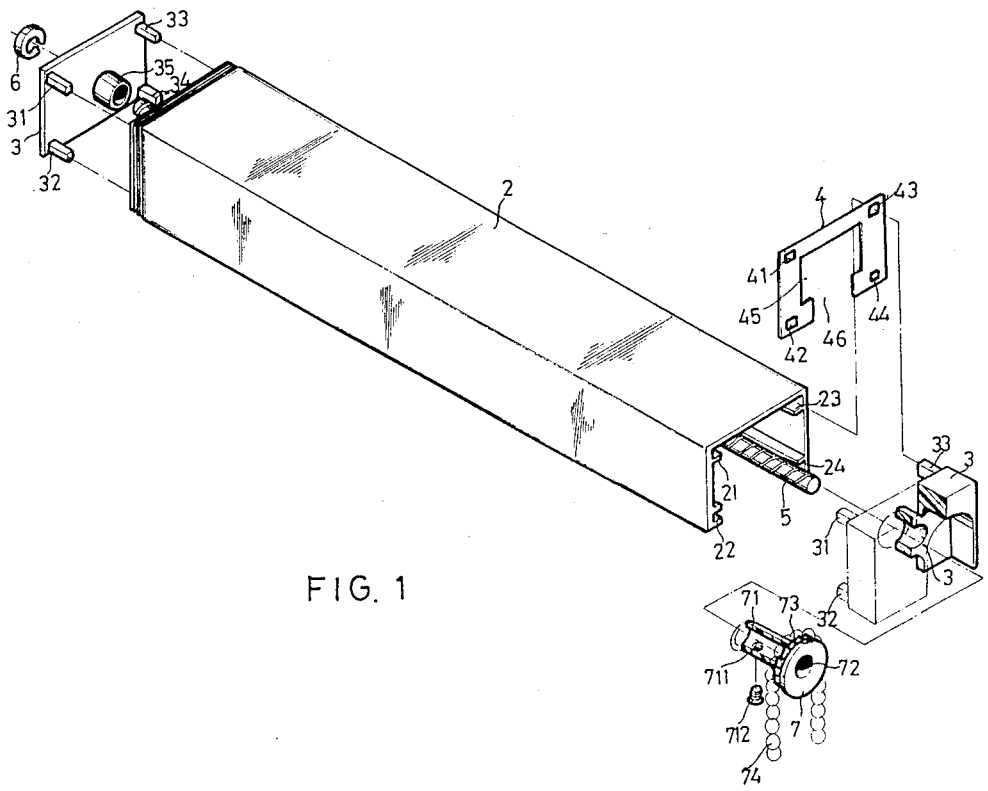
FIG. 1 is an exploded view of a blind according to the invention.

Referring first of all to FIG. 1, an illustration of the main parts of the invention structure in regard of the lengthwise adjustments, it is seen that the invention comprises:

a pi-shaped skyrail 2, of which the interior is provided with foot bumper spanning channels 21, 22, 23, 24 executed in two pairs opposite each other, to account for two side faces of the skyrail 2, prolonged foot bumpers 31, 32, 33, 34 as provided projectingly on the interior side of each side lid 3 is respectively engaged with the opening ends on the side face of skyrail 2, to permit advance provision of a plurality of spacers 4 for hanging on the foot bumpers 31, 32, 33, 34 before the interior section of each foot bumper 31, 32, 33, 34 is introduced into the spanning channels 21, 22, 23, 24, for clinging inside the side lid 3, thereby holding the skyrail 2 apart from the side lid 3, which can be construed as serving to increase the lengthwise length of the skyrail.

The spacer 4 is approx equal in area to the inside face of the side lid 3, at least four corners are provided to facilitate the foot bumpers 31, 32, 33, 34 being passed in pairs onto the helical mandrel 5 in the middle of the access ports 41, 42, 43, 44 and the access hole 45 for the enlargement of other horizontal components. The part passing the underside of the access port 45 may be cut into a hollow section 46, so that the spacer 4 is rendered into a pi-shaped piece member, serving primarily to facilitate passing across mandrel 5 straight downwards straight, only to be checked upon by the hanging from the foot bumpers 31, 32, 33, 34. As to the quantity of the spacers 4 for superposition, it depends largely upon the width to be lengthened, the overall thickness of respective spacers 4 required to achieve optimum superposition, and by taking into account the operating position.

The helical mandrel 5 is supported horizontally inside the skyrail 2, such that while one end is being hung, the shaft hole 35 facilitates penetration of the respective end of the mandrel 5 into a middle point of one side lid 3, to bring the terminal end of the mandrel 5 through that side lid snap-on positioning by an external C shaped snap ring 6. The other end of the mandrel 5 is hung by the central hole 72 of the rotary sleeving 7 setting on a coupling hole 36 provided in the center of that side lid 3, by virtue of passing into a frontal extended sleeving 71 from the outward side of the side lid 3. A front part of the frontal extended sleeving 71 of the rotary sleeving 7 is provided with a screw hole 711, so as to allow an external locking bolt 712 to be locked in from the bottom open side of the skyrail 2, the terminal end of the bolt bearing against the side of the mandrel 5. Thusly the locking bolt 712 is both releasable and lockable, and the mandrel 5 is able to slide inside the central shaft hole 72 and becomes fixedly locked thereon so that, with an increase of the number of spacers 4 provided, a backout adjustment is made possible, thereby achieving lengthwise adjustments. Since the coupling provided by the frontal extended sleeving 71 is installed in a extends forwardly, the mandrel 5 continues to be held by central hole 72 in conjunction with a receding of each side lid 3 away from the skyrail 2, allowing continued fixed locking by the locking bolt 712. Thus a rear part of the rotary sleeving 7 is maintained in the opening 36 in the side this rear part being executed in the form of an annular bead coulisse 73, to accept to heavy pull for rotation by an annular bead chain 74. Thus the mandrel 5 is driven for rotation, thereby controlling the orientation adjustment of the curtain drapery indoors. The shifting adjustment, occurs under the command of a pull rope, is not relevant to this case, and accordingly is ommitted from further description.

A comparison of FIG. 2A with FIG. 2B shows that once spacing members 4 are introduced between side lids 3 on both sides of the skyrail 2 and the skyrail 2, for superposition in-between each foot bumper 31, 32, 33, 34, the thickness 'A' is produced as a result of such a superposition. The lock bolt 712 is released to allow respective to side lid 3 to recede by an amplitude 'A' outwardly, the rotary sleeving 7 will in the meantime kick back a like distance 'A' before again fixedly setting the lock bolt 712. Thereby lengthwise adjustment of the skyrail 2 is achieved by means of the addition of a distance 'A', with a view to meet job execution requirements.

The disclosure going thus far should prove that the structure of the invention truly achieves flexible latitude for on the job operation of the skyrail, and in making possible skyrail dimension free of specificational restrictions. It is therefore considered a truly worthwhile piece of invention.

I claim:

1. A vertical venetian blind skyrail permitting lateral adjustment comprising a skyrail body, structured like an oblong rail having two ends, said skyrail body having a cross-section in the shape of the Greek letter pi, each said end of the skyrail body having two pairs of foot bumper channels, with a first of said foot bumper channels of each said pair being located opposite the other foot bumper channel of the same pair, a pair of opposite side lids, a first one of said side lids being provided near a midpoint thereof with a round, penetrating shaft hole, the second of said side lids having a round penetrating hole of a larger size, each said side lid having four interior corners with foot bumpers extending from said interior corners for fitting into respective ones of said foot bumper channels at said two ends of said skyrail body, to cover the lateral sides of the skyrail body, said round penetrating hole of a larger size in said second side lid having a smaller diameter on an interior part of the hole extending to an interior face from which said foot bumpers extend than on an exterior part extending to an opposite exterior face of said second side lid, a rotary sleeving having an enlarged rear section housing in said exterior part of said rotary sleeve and a frontal section extending from said enlarged rear section and projecting through said interior part of said hole of said rotary sleeve with said smaller diameter, said rotary sleeving having a central hole extending axially therethrough, said rotary sleeving being insertable into said second side lid from said exterior face thereof, said frontal section having a screw means at an end thereof opposite said enlarged rear section, and a helically shaped mandrel having a first end inserted through said shaft hole in said first side lid and retained therein by a C shaped snap ring and second end retained by said screw means in said frontal section of said rotary sleeving, and spacing members, each having a shape corresponding to said interior faces of said side lids and said cross-section of said skyrail body, each said spacing member having at least four corners with holes for fitting on said foot bumpers and for passing across a middle, enlarged access port, wherein the insertion of a desired number of said spacing members as required, in superposition on the foot bumpers between the side lids and the ends of said skyrail body, facilitates said lengthwise adjustment.

2. The skyrail according to claim 1, wherein said shape of each said spacing member is also formed in the shape of the Greek letter pi, to facilitate straddling downwards on the skyrail body, while hanging upon the foot bumpers of the side lids.

* * * * *